US006275450B1

(12) United States Patent
Makiba

(10) Patent No.: US 6,275,450 B1
(45) Date of Patent: Aug. 14, 2001

(54) TIMEPIECE

(75) Inventor: Hidenori Makiba, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/319,466

(22) PCT Filed: Oct. 7, 1998

(86) PCT No.: PCT/JP98/04544

§ 371 Date: Jun. 4, 1999

§ 102(e) Date: Jun. 4, 1999

(87) PCT Pub. No.: WO99/18479

PCT Pub. Date: Apr. 15, 1999

(30) Foreign Application Priority Data

Oct. 8, 1997 (JP) ..... 9-276298

(51) Int. Cl.[7] ..... G04B 19/04; G04B 25/00; G04B 37/00

(52) U.S. Cl. ..... 368/80; 368/223; 368/294

(58) Field of Search ..... 368/76, 80, 88, 368/223, 228–233, 236, 276, 281, 294–296, 309

(56) References Cited

U.S. PATENT DOCUMENTS 4,436,435 * 3/1984 Ushikoshi ..... 368/71
4,706,238 11/1987 Kizawa .
5,043,955 8/1991 Dubois et al. .

FOREIGN PATENT DOCUMENTS 535453 3/1973 (CH) .
7319908 5/1973 (DE) .
85 30 739 U 5/1986 (DE) .
0 676 679 A1 10/1995 (EP) .
49-134182 11/1974 (JP) .
60-66177 4/1985 (JP) .
61-48389 4/1986 (JP) .
2-281181 11/1990 (JP) .
5-288866 11/1993 (JP) .
7-325168 12/1995 (JP) .

* cited by examiner

*Primary Examiner*—Vit Miska

(57) ABSTRACT

Formed in glass framing (21) attached to a watch case (20) are a main opening (21*a*) and four sub-openings (21*b*, 21*c*, 21*d*, 21*e*), with display window members (22, 23, 24, 25, 26) respectively engaged and fixed to each. Positioned at the rear side of the glass framing (21) are dials (27, 27'), and a time-of-day indicating area (27*a*) which is round to the view when viewed flat is provided to the dial (27). A round opening (27*a'*) corresponding to the time-of-day indicating area (27*a*) is formed to the dial (27') adhered on the dial 27, and four sub-indicating areas (27*b'*, 27*c'*, 27*d'*) which are round to the view when viewed flat are formed on the surface of the dial (27'). The time-of-day indicating area and sub-indicating areas are arranged so as to be separately viewed by the respective display window members.

7 Claims, 6 Drawing Sheets

TIMEPIECE

TECHNICAL FIELD

The present invention relates to a time piece, and particularly relates to a time piece which has a sub-display system other than a main time display system, such as with a multi-functional watch or the like.

BACKGROUND ART

Conventionally, common analog wristwatches are configured with a dial 11 provided within a watch case 10, and a display window member 12 formed of a single piece of glass or the like is on the front side of the dial 11, as shown in FIG. 14 and FIG. 15. A through hole is formed in the center of the dial 11, and a main needle driving portion 13 protrudes through this through hole from the movement stored within the watch case 10. Attached to this main needle driving portion 13 are an hour hand 14 and minute hand 15. Also, a plurality of through holes are further formed around the through hole in the dial 11, from which through holes protrude a plurality of sub-needle driving portions 16, with needles 17 attached to each. Further, the dial 11 is designed so that sub-indicating areas 11*a,* 11*b,* and 11*c* formed according to the needles 17 can be distinguished from other portions of the dial 11, by means of printing or the like. Incidentally, an open window 11*d* is formed on the dial 11, so as to allow viewing of the day indicator (or date indicator) through this open window 11*d.*

With the above analog wristwatch, the dial 11, window member 12, main needle driving portion 13, hour hand 14, minute hand 15, sub-needle driving portions 16, needles 17, etc., comprise a display portion. The dial 11, main needle driving portion 13, hour hand 14, and minute hand 15 comprise a time display system which allows one to read the time-of-day from the marks or numbers displayed on the periphery of the dial 11 positioned on the display area of the hour hand 14 and minute hand 15. In this case, the sub-display system comprised of the sub-needle driving portions 16 and needles 17 are provided with separate needles for displaying only one of the hour hand, minute hand, or second hand, or, needles for displaying other values such as time other than time-of-day, water pressure, air pressure, temperature, humidity, and so forth, so as to display information which is part of the time display system or other information. Watches which have such a sub-display system are called multi-functional wristwatches, and can be used in various ways other than conventional display of the time of day.

The sub-indicating area of the sub-display system in such multi-functional wristwatches is generally positioned within the time-of-day indicating area which is the range of movement of the needles of the time display system (hour hand 14, minute hand 15) in an overlaid manner, so that the time-of-day indicating area of the time-of-day display system and the sub-indicating area of the sub-display system overlap in a plane. That is, the time-of-day display system is generally connected at the center of the disk-shaped dial 11 comprising the display portion, with needles extending in the periphery of the dial, so that the indicating area of the time-of-day display system encompasses almost the entirety of the display portion. On the other hand, the sub-display system is connected at a portion other than the center of the dial, and has a small sub-indicating area included in the time-of-day indicating area which makes display with needles much shorter than the radius of the dial.

Now, a stopwatch is a type of the above-described watch, and in the case of a stopwatch, a time display system is provided instead of a time-of-day display system. The phrase "time display system" will hereafter be used as a concept including both the time-of-day display system and time display system.

However, with such multi-functional wristwatches, the indicating area of the time-of-day display system which encompasses almost the entirety of the display portion, and the sub-display system are positioned so as to overlap in a plane, meaning that the needles of the time display system and the sub-indicating area of the sub-display system visually overlap, which is problematic since the display becomes difficult to read.

Also, the time display system and sub-display system are positioned overlapping on the display portion, giving an overall impression of the display portion being complicated, and major changes in design cannot be made.

Accordingly, the present invention has been made to solve the above problems, and the objects thereof are to provide a new time piece, comprising a time piece which has a time display system and a sub-display system such as with a multi-functional watch, having a display portion wherein ease of reading is facilitated and design not giving a complicated impression can be made.

DISCLOSURE OF INVENTION

The means according to the present invention for solving the above objects consists of: a time piece, comprising within a display portion for making various types of display: a time display system for displaying time-of-day or time, with one or a plurality of needles; and a sub-display system for displaying time-of-day, time, or other physical quantities, with one or a plurality of needles; the aforementioned time piece being constructed such that the time indicating area of the aforementioned needle(s) in the aforementioned display system, and the sub-indicating area of the aforementioned needle(s) in the aforementioned sub-display system do not overlap on a plane.

According to such means, the time indicating area in the display system and the sub-indicating area in the sub-display system do not overlap on a plane, so deterioration in visual recognition owing to a needle of one covering the display of another, or erroneous reading of the displays can be prevented. Also, owing to the same reason, the design of the display portion is not complicated, there are fewer restrictions on design from overlapping of the time indicating area and the sub-indicating area, facilitating relatively free configuration of a simple design.

Now, it is preferable that the time indicating area of the aforementioned time display system is positioned either at the center portion of the aforementioned display area, or along a central axis extending vertically through the field of view in the event that the aforementioned display portion is viewed at a normal attitude.

According to such means, the time indicating area of the time display system is positioned at the center portion of the display area, or positioned along a central axis extending vertically (e.g., in the direction from 12 o'clock to 6 o'clock on a normal clock) through the field of view in the event that the display portion is viewed at a normal attitude, whereby instantaneous visual recognition of the time display system an be improved, and the display can be correctly read without confusion.

Also, it is preferable that the aforementioned time indicating area of the aforementioned time display system is formed with a greater area than that of the aforementioned sub-indicating area of the aforementioned sub-display system.

According to such means, the time indicating area is formed with a greater area than that of the sub-indicating area, whereby instantaneous visual recognition of the time display system an be improved, and the display can be correctly read without confusion.

Further, it is preferable that the aforementioned time display system has more of the aforementioned needles than the aforementioned sub-display system.

According to such means, the time display system has more needles than the sub-display system, meaning that the display system with more needles is the time display system, whereby instantaneous visual recognition of the time display system an be improved, and the display can be correctly read without confusion.

It is also preferable that the color of the aforementioned needles or the aforementioned time indicating area of the aforementioned time display system differs from the color of the aforementioned needle(s) or the aforementioned sub-indicating area of the aforementioned sub-display system.

According to such means, the color of the time display system differs from the color of the sub-display system, whereby the type of display system can be judged by color, so judgment of the display systems can be made speedily and easily.

Further, it is preferable that the periphery form of the aforementioned time indicating area of the aforementioned time display system differs from the periphery form of the aforementioned sub-indicating area of the aforementioned sub-display system.

According to such means, the periphery form of the time indicating area differs from the periphery form of the sub-indicating area, whereby the type of display system can be judged by periphery form, so judgment of the display systems can be made speedily and easily.

It is preferable that, in each of the above means, the aforementioned time indicating area of the aforementioned time display system is provided with a time displaying dial, and wherein the aforementioned sub-indicating area of the aforementioned sub-display system is provided with a sub-displaying dial which is separate from the aforementioned time displaying dial.

According to such means, the time indicating area and the sub-indicating area are provided with differing dials, whereby the design of the display portions can be independently and easily configured, and each display system can be maintained separately, so ease in design configuration and handling of the display systems is facilitated.

It is preferable that, in each of the above means, the face of the aforementioned display portion is provided with a covering, comprising: a time displaying window for allowing visual recognition of the aforementioned time indicating area of the aforementioned time display system, and a separate sub-displaying window for allowing visual recognition of the aforementioned sub-indicating area of the aforementioned sub-display system.

According to such means, a time displaying window and sub-displaying window are provided to a cover on the face of the display portion, for allowing visual recognition of the time indicating area and sub-indicating area, so the display systems are not confused, and can be read with fewer erroneous readings and erroneous recognition. Also, even in the event that a configuration is made wherein the indicating areas of the display systems are shifted backwards or forwards in the direction of visual recognition, the area other than the time indicating area and sub-indicating area are covered by the covering, so a three-dimensional display portion can be configured without providing special structures or interfering with the design.

Now, the covering may be integrally formed with the case of the time piece, or may be separate from the case proper but cooperating with the case proper to configure a portion of the case. Or, this may be provided as a plate-shaped member having display windows on the inner side of a transparent window material, such as cover glass or the like, comprising a portion of the case.

In this case, it is preferable that the aforementioned covering has a fitting; structure which fits to the aforementioned dial comprising the aforementioned time indicating area and/or the aforementioned sub-indicating area and performs position restriction. Providing the covering with a fitting structure which fits to the dial directly positions the covering and dial, so there is less shifting in position than conventional constructions wherein positioning is performed by the watch movement, an inner frame, or other parts, and deterioration of the outward appearance and impression of quality owing to shifting in position between the time display window and time indicating area or the sub-display window and sub-indicating area can be suppressed.

Particularly, the time indicating area and the sub-indicating area are visually recognized through the time display window and the sub-display window provided to the covering, so shifting in position between the covering and dial is easily discovered. However, with the conventional structure wherein the watch case and dial are positioned by the watch movement or the like, the structure is not such therein the covering and dial are directly positioned, and in the event that such an apparatus structure is used, it is difficult to manufacture a product having a suitable external appearance. With the present invention, the covering and dial can be directly positioned, so shifting in position can be easily reduced, a suitable external appearance can be obtained, and ease of assembly at the time of manufacturing is facilitated.

In this case, it is further preferable that the aforementioned fitting structure is provided to the aforementioned rear side of the aforementioned covering at portions other than the aforementioned time displaying window and the aforementioned sub-displaying window. Configuring the fitting structure at the rear side of the covering at portions other than the time displaying window and the sub-displaying window allows for a configuration wherein the fitting structure is not visually recognized externally.

Now, it is preferable that the aforementioned fitting structure comprises a fitting pin fit into a receiving recession formed in the aforementioned covering and fixed thereto, with a guide hole or guide opening to which the aforementioned fitting pin may fit being formed in the aforementioned dial.

In this case, it is preferable that the aforementioned fitting pin comprises: a base portion having a bottom plane form which approximately matches the bottom portion of the aforementioned receiving recession; a tip portion which protrudes from the aforementioned receiving recession and which is configured so as to fit with the aforementioned dial; and an intermediate portion which has a tapered form so as to secure space for an adhesive to pool. Inserting the base of the fitting pin into the receiving recession and injecting an adhesive agent or the like into the receiving recession allows the precision of attachment of the fitting pin to the covering to be improved and sufficient attachment strength to be obtained, and further, reducing the length of the fitting pin does not interfere with the attachment precision or attachment strength, so this does not obstruct reducing the thickness of the time piece.

In each of the above means, it is preferable that the aforementioned dial is restricted position-wise in the radial direction by another member besides the aforementioned fitting structure, and is restricted position-wise in the rotational direction by the aforementioned fitting structure. The fitting structure only needs to restrict position in the rotational direction, so the fitting structure is simplified, so this does not readily interfere with reducing the thickness of the time piece.

In this case, it is preferable that the aforementioned dial and the aforementioned fitting structure are fit with leeway in the radial direction. The fitting structure is fit to the dial with leeway in the radial direction, so this does not interfere with position-wise restriction on the radial direction of the dial.

In each of the above means, arrangements may be made wherein a plurality of the aforementioned fitting structures is provided, and the aforementioned dial is restricted position-wise in the radial direction and rotational direction by the plurality of the aforementioned fitting structures.

In this case, it is preferable that there is fitting leeway in the radial direction to the aforementioned dial, with a first of the aforementioned fitting structures which performs positional restricting in the rotational direction, and a second of the aforementioned fitting structures which performs positional restricting in the radial direction. Position-wise restriction of the dial can be performed in the rotational direction by means of the first fitting structure and second fitting structure without obstructing position-wise restriction in the radial direction, and position-wise restriction in the radial direction can be performed by means of the second fitting structure.

Another invention disclosed in the present Description is a time piece, comprising on the surface of a dial positioned within a display portion for making various types of display: a plurality of display systems for displaying time-of-day, time, or other physical quantities, with one or a plurality of needles; wherein the face of the aforementioned display portion is provided with a covering, having a plurality of display windows for allowing separate visual recognition of each of the plurality of aforementioned display systems.

In this case, it is preferable that the aforementioned covering has a fitting structure for fitting to the aforementioned dial and performing position-wise restriction. This covering may be configured as the case itself or as part of the case. It is preferable that the above fitting structure be provided to the rear side of the covering facing the dial at portions other than the aforementioned displaying windows.

BEST MODE FOR CARRYING OUT THE INVENTION

Next, embodiments of the present invention will be described in detail, with reference to the attached drawings.

[First Embodiment]

Figure 1:
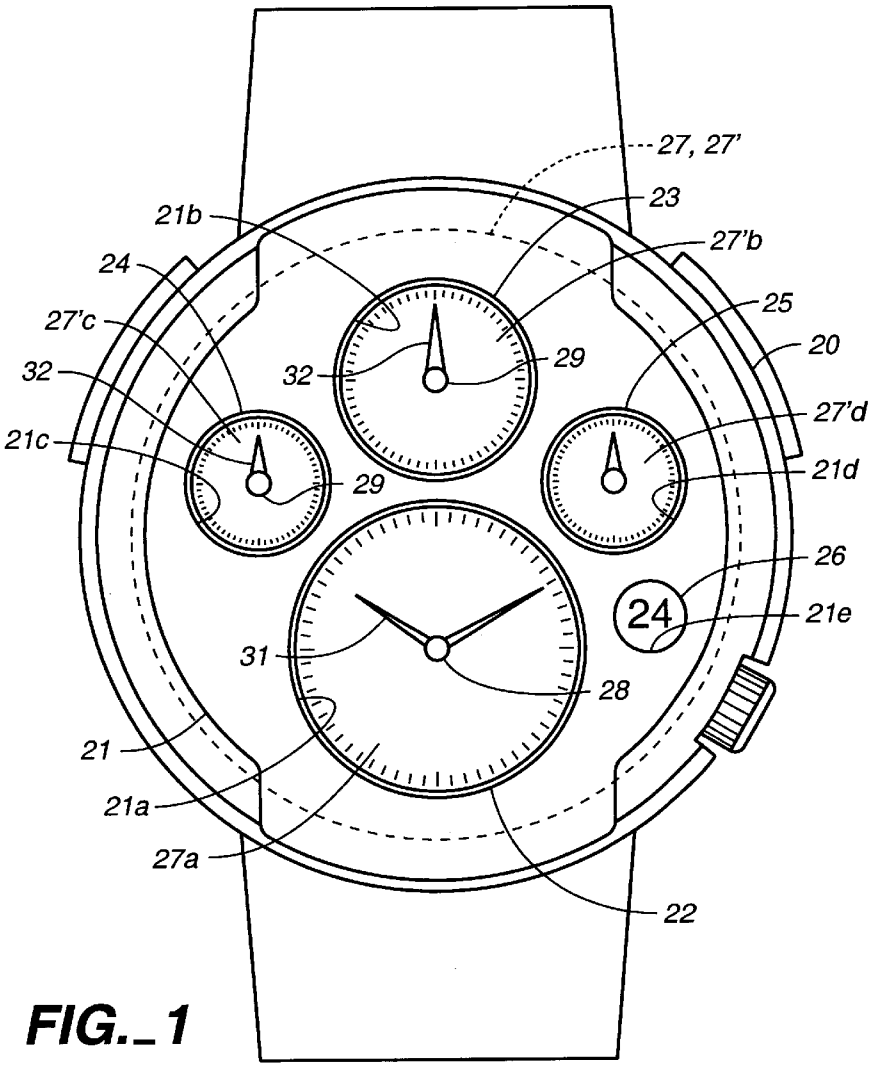
FIG. 1 is a schematic plan view of a display portion illustrating the structure of a watch proper according to a first embodiment of the time piece according to the present invention.

FIG. 1 is a schematic plan view of a display portion illustrating the structure of a watch proper according to a first embodiment of the time piece according to the present invention. This embodiment is a multi-functional wristwatch, and FIG. 1 is a view of this multi-functional wristwatch from a normal direction of visual recognition. A stainless-steel glass framing 21 which is a covering member is attached to the face of the watch case 20. This glass framing 21 is fixed to the watch case 20 by means of caulking or the like. Formed in this glass framing 21 are a main opening 21*a* and four sub-openings 21*b*, 21*c*, 21*d*, and 21*e*. Engaged and fixed to these openings are display window members 22, 23, 24, 25, and 26. At least one of these display window members 22, 23, 24, 25, and 26 may be formed of a glass material or transparent resin material serving as a lens to increase visual recognition.

Figure 2:
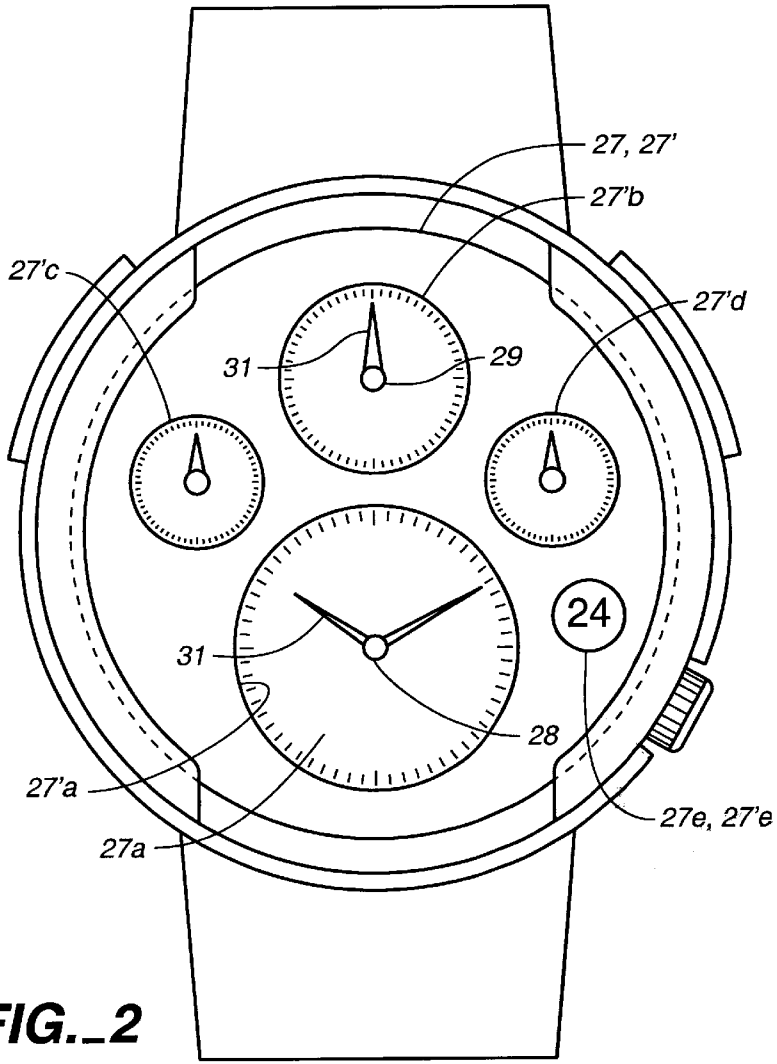
FIG. 2 is a schematic plan diagram illustrating the watch proper according to the first embodiment with the glass framing thereof removed.

Positioned at the rear side of the glass framing 21 are dials 27 and 27' indicated by dotted lines. The dials 27 and 27' are round thin plates formed of metal or the like, and are layered one on another by an adhesive agent or the like. As shown in FIG. 2 illustrating the state with the glass framing 21 removed, FIG. 3 which is a cross-sectional view cut in the direction of 12 o'clock to 6 o'clock (the direction connecting 12 o'clock to 6 o'clock on a normal single-function wristwatch), and FIG. 4 which is a cross-section cut so as to pass through the sub-indicating area 27'*c* of the sub-display system and the display windows 27*e* and 27'*e*, a time-of-day indicating area 27*a* which is round to the view when viewed flat, and a round opening 27'*a* corresponding to the time-of-day indicating area 27*a* is formed to the dial 27 adhered above. Also, sub-indicating areas 27'*b*, 27'*c*, and 27'*d* which are round to the view when viewed flat are formed on the surface of the dial 27'. The time-of-day indicating area 27*a* and the sub-indicating areas 27'*b,* 27'*c,* and 27'*d* each have a through hole formed in the center thereof, with a main needle driving portion 28 protruding from the through hole formed in the center of the time-of-day indicating area 27*a* and sub needle driving portions 29 protruding from the through holes formed in the sub-indicating areas 27'*b,* 27'*c,* and 27'*d.* Needles 31 for indicating the time of day, such as the hour hand, minute hand, second hand, etc., are attached to the main needle driving portion 28, and sub-display needles 32 for indicating various physical quantities, besides an hour hand, minute hand, and second hand, are attached to the sub-needle driving portions 29.

Figure 4:
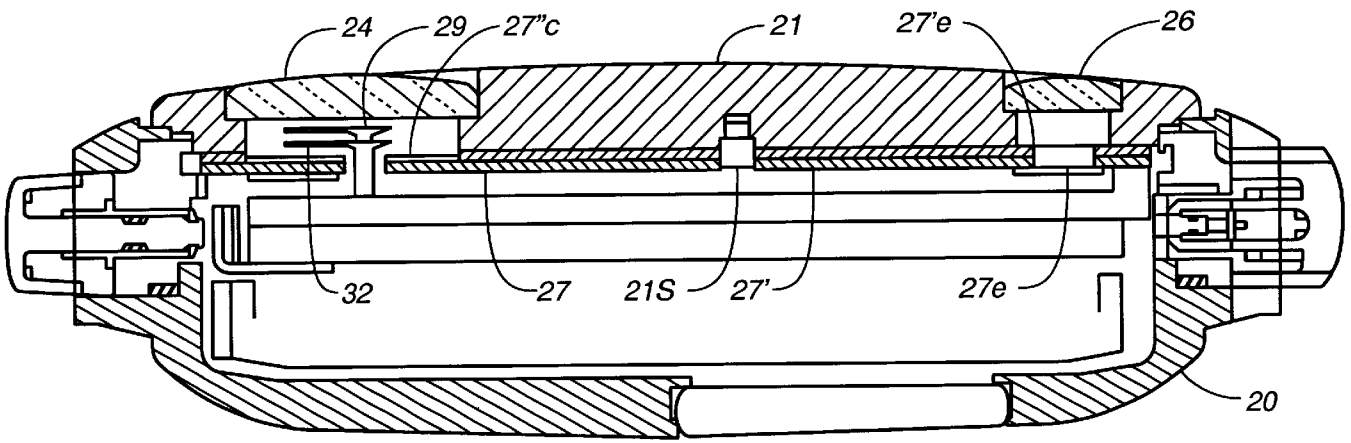
FIG. 4 is a schematic cross-sectional diagram illustrating the watch proper according to the first embodiment cut at a different portion (periphery).
Figure 14:
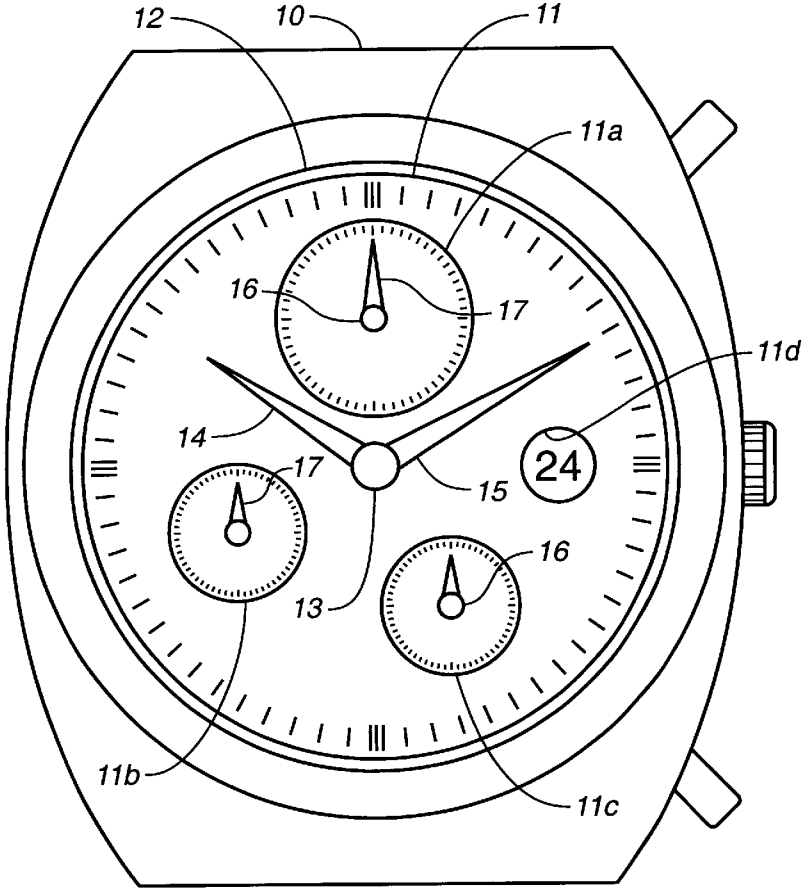
FIG. 14 is a plan view of the display portion illustrating the structure of the watch proper according to a conventional multi-functional wristwatch.

Incidentally, as shown in FIG. 4, a plurality of positioning pins 21S are attached to the base of the glass framing 21, and the configuration is such that positioning is performed by these positioning pins 21S engaged with guide openings or guide holes formed in the dials 27 and 27'.

Figure 3:
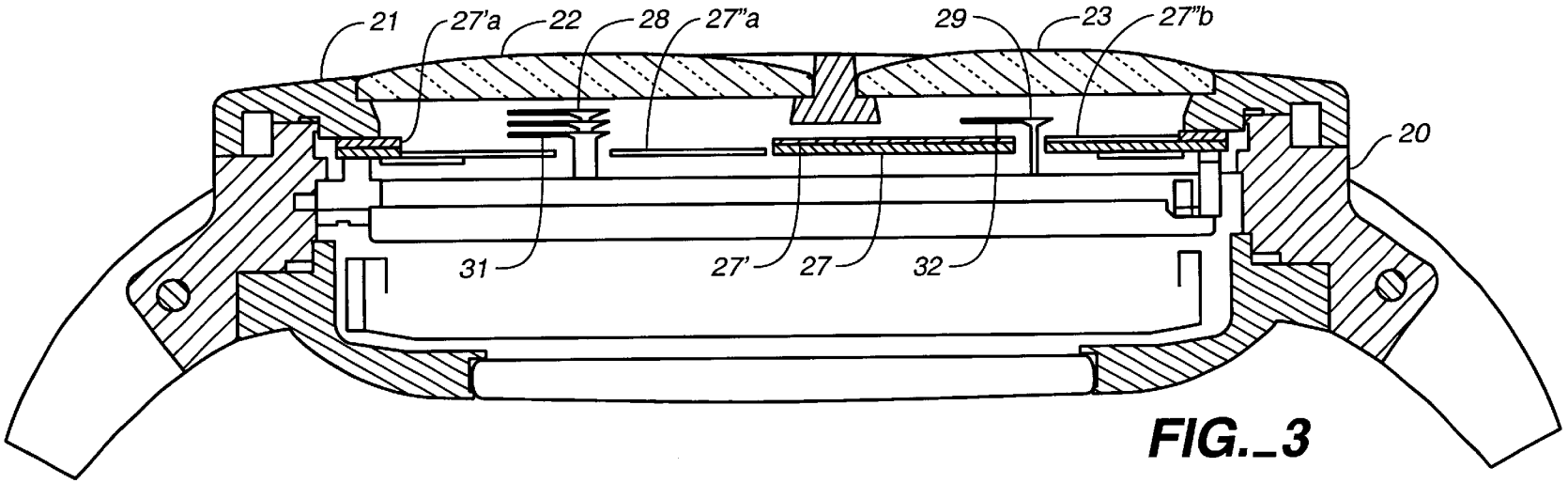
FIG. 3 is a schematic cross-sectional diagram illustrating the watch proper according to the first embodiment cut in the direction of 12 o'clock to 6 o'clock.

As shown in FIG. 3 and FIG. 4, disk-shaped ornamental plates 27"*a,* 27"*b,* 27"*c,* and 27"*d* are embedded in the dials 27 and 27' in the time-of-day indicating area 27*a* and the sub-indicating areas 27'*b,* 27'*c,* and 27'*d.* The method of attaching the ornamental plates to the dials may be simple adhesion or engaging. These ornamental plates have different material and external appearance in comparison to that of the dials. The ornamental plates may be formed of polished natural shells such as peal oyster or abalone, formed of polished precious stones, various types of ceramic plates, metal plates such as stainless steel or titanium or other plate materials with radial or linear grooves, plate materials with mirror-polished surfacing, members made coarse by honing, and so forth. Also, various printed plate materials may be used for the configuration.

In the present embodiment, the time-of-day indicating area 27*a,* main needle driving portion 28, and needles 31 for indicating the time of day make up the time-of-day display system, while the sub-indicating areas 27'*b,* 27'*c,* and 27'*d,* sub-needle driving portions 29, and sub-display needles 32 make up the sub-display system. Now, a time display system for displaying time such as a time piece may be provided instead of the time-of-day display system, and the sub-display system may comprise a portion of time display for supplementing the time-of-day display, e.g., year, month, date, AM/PM, hour, minute, second, etc., either independently or as a combination differing from the time-of-day display, or a display for various physical quantities, such as a display of time timed by a time piece such as final time, lap time, etc., a display of temperature or humidity, a display of atmospheric pressure, altitude, water pressure, water depth, a display of movement of heavenly bodies such as the sun, moon, planets, stars, and so forth.

Display windows 27*e* and 27'*e* are bored in the dials 27 and 27', so that visual recognition of the date display of the date indicator can be made through these display windows 27*e* and 27'*e.* These display windows 27*e* and 27'*e* may also be configured to allow visual recognition of displays other than the date, such as display of the day-of-week, year, month, AM/PM, and so forth.

According to the present embodiment, the time display system for displaying time-of-day, time, and so forth on the display portion of the wristwatch, and the sub-display system for performing various displays of time-of-day, time, and other various displays are positioned so as not to overlap in a plane, so the time-of-day and other displays are not easily erroneously recognized. That is, the time-of-day display system and other sub-display systems are removed one from another, so the needles of one do not cover the display of another, and difficulty to view the display or erroneous recognition owing to the needles of one and the needles of another, or the indicating area of one and the indicating area of another being confused, is reduced.

In order to prevent confusion or illusion between the time display system and sub-display system, it is preferable to emphasize the difference between the most commonly used time display system and the other sub-display system. For example, the indicating area of the time display system may be made to have a greater diameter than the indicating area of another sub-display system, the time display system may be positioned in the center of the display portion, or positioned along a central axis extending vertically through the field of view in the event that the display portion is viewed at a normal attitude, e.g., along an axis line in the direction from 12 o'clock to 6 o'clock on a normal clock, thereby making the time display system to stand out in comparison with the other sub-display systems, allowing instant reading of the time-of-day and so forth.

Particularly, it is preferable that the time-of-day indicating area 27*a* or needles 31 be of a different design or color than the sub-indicating areas 27'*b,* 27'*c,* and 27'*d* or sub-display needles 32. For example, this includes printing with colors including metal colors, mirror-polishing, course surfacing, grooved design, striped design, etc. The difference may be visually recognized by changing the material for certain portions. Such configurations allow the dime-of-day display system and the sub-display system to be differentiated at a glance, so the contents of display on the display portion can be instantaneously read. Difference in form and differing in design and color between the display systems may be provided to the needles, dial surface, or both. For example, only the form of the needles may be changed.

Particularly, unlike conventional multi-functional wristwatches, the present embodiment has a glass framing 21 which is a covering material configured so as to cover the entirety of the display portion, the display portion is of a multiple configuration, and openings provided with multiple display window members 22, 23, 24, 25, and 26 are provided to this glass framing 21, so the time-of-day display system and sub-display system are clearly separated and observed, and consequently, the display form is easy to view with little confusion or erroneous recognition. Also, the time-of-day indicating area 27*a* of the time-of-day display system is formed on the surface of the dial 27, and the sub-indicating areas 27'*b,* 27'*c,* and 27'*d* of the sub-display system are formed on dials 27' layered on the dial 27.

Thus, the glass framing 21 is configured so as to allow visual recognition in the state of separating the display systems, so the display systems can be differentiated in the thickness (depth) direction as well, in addition to the size, form, design, and color thereof. With the present embodiment, the time-of-day display system alone is formed at a position deeper than the other sub-display systems, so the time-of-day display system alone is formed at a position deeper than the other sub-display systems, and thus is readily differentiated from the other sub-display systems in three-dimensional perception, as well. Of course, the present invention is not restricted to such structures, but three-dimensional perception can be increased since the position of each of the needles and indicating areas can be changed in the thickness (depth) direction, by effectively using the structure wherein the display systems are divided by the glass framing. Also, even in the event that such as three-dimensional structure is made, the area between the display systems can be hidden by the glass framing 21, so better design can be made with a simpler structure than that of the conventionally employed layered dials in order to increase three-dimensional perception.

In the present embodiment, the indicating areas of the display systems are divided one from another, so small pieces of material with small diameters can be used in the event of using expensive materials such as shells or precious stones, and thus the present embodiment is advantageous in that manufacturing is inexpensive. Also, regarding ornamentation of the ornamental plates, the configuration is divided into a plurality thereof, so each can be procured at lower costs. Particularly, separate designs can be made for each of the ornamental plates, or radial or linear stripes or grooves for example can be provided to each of the ornamental plates, so freedom in design can be improved while suppressing manufacturing costs.

Also, in the above configuration, the display window members 22, 23, 24, 25, and 26 may be formed of lenses, so that each display thereof is visually recognized in an enlarged manner. This suppresses deterioration in visual recognition owing to each display portion being formed small as with the present embodiment.

[Second Embodiment]

Figure 5:
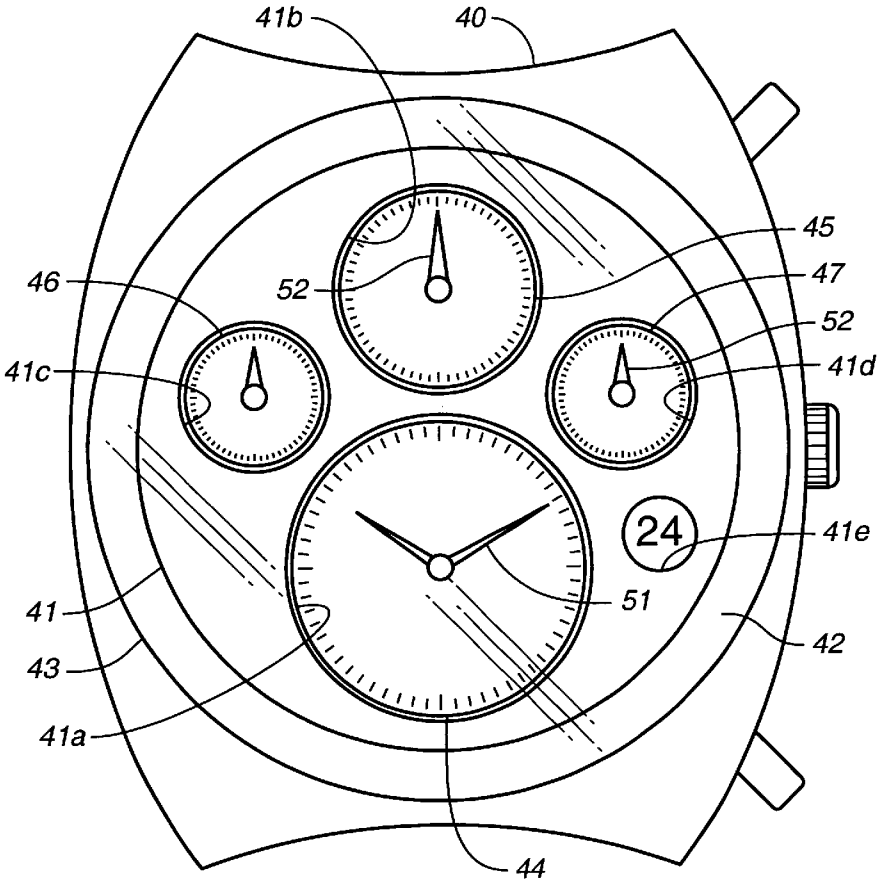
FIG. 5 is a schematic plan view of a display portion illustrating the structure of a watch proper according to a second embodiment of the time piece according to the present invention.

Next, a second embodiment of the time piece according to the present invention will be described with reference to FIG. 5. The present embodiment differs from the above embodiment in that one frame plate 41 is positioned inside the watch case 40 in the state of being pressed by a dial ring 42. Formed to this frame plate 41 are openings 41*a*, 41*b*, 41*c*, and 41*d*, and positioned within each of these are small dials 44, 45, 46, and 47, each printed with marks or numerals. Needles 51 comprising the time-of-day display system rotate over the dial 44, and needles 52 comprising the sub-indicating systems rotate over the dials 45, 46, and 47. The display window 41*e* is of the same structure as that of the above first embodiment.

With the present embodiment, one transparent display window member 43 is attached before the time-of-day display system and the sub-indicating systems comprised of the above frame plate 41, dials 44, 45, 46, and 47, needles 51 and 52, etc. Also, with the present embodiment, a plurality of movements corresponding wit the above dials 44, 45, 46, and 47 are stored within the watch case 40, each being configured so as to be capable of being extracted individually. Of course, even in the case that the movements are separate, the configuration may be such wherein the movements act cooperatively by mutually exchanging driving signals, control signals, and so forth.

In this embodiment as well, the time-of-day display system and sub-display system are positioned so as to not overlap in a plane, so visual recognition of the display systems improves, and erroneous reading of the display can be prevented. Also, owing to the same reason, the design is not complex, and a simple design can be made relatively freely.

With the present embodiment, the dial 44 comprising the time-of-day indicating area and the dials 45, 46, and 47 comprising the sub-indicating areas can be separately configured, so the design configuration of each of the indicating areas can be easily changed. Also, even in the event of using ornamental plates as with the above, small material with small diameters can be used. Further, at the time of maintenance, the display portions can each be individually disassembled and repaired, facilitating ease of maintenance.

Though the above embodiments describe the present invention applied to the display portion of a wristwatch proper, the present intention is not restricted to wristwatches but rather can be applied to various types of clocks, and can further be broadly applied to time pieces such as stopwatches, timers, etc., without being restricted to clocks.

Also, in the above embodiments, the periphery form (the so-called panel form) of the time indicating area such as the time-of-day indicating area, and the periphery form of the other sub-indicating areas are both formed as round shapes when viewed flat. However, differentiation between the display systems can be made even more easily and speedily by differentiating the periphery form of the of the time indicating area and the periphery form of the other sub-indicating areas. For example, the periphery form of the main time indicating area may be circular, and the periphery forms of the other sub-indicating areas be polygons, fan shapes, ellipses, elongated circles, and so forth.

There may be multiple sub-display systems, and may each have forms and colors of the same type, or of mutually differing types. Regarding the sub-display system, e.g., in the event that, e.g., a sub-display system which displays only the hour or minute, a sub-display system which displays only seconds, a sub-display system which displays only 1/10 of seconds, etc., are provided, the sub-display systems may be positioned in order of ascending size of increments of time in a clockwise arrangement, or conversely, the sub-display systems may be positioned in order of descending size of increments of time in a clockwise arrangement.

Incidentally, the time piece according to the present invention may be an electronic (e.g., electronic clock) or a mechanical time piece (mechanical clock).

[Third Embodiment]

Figure 6:
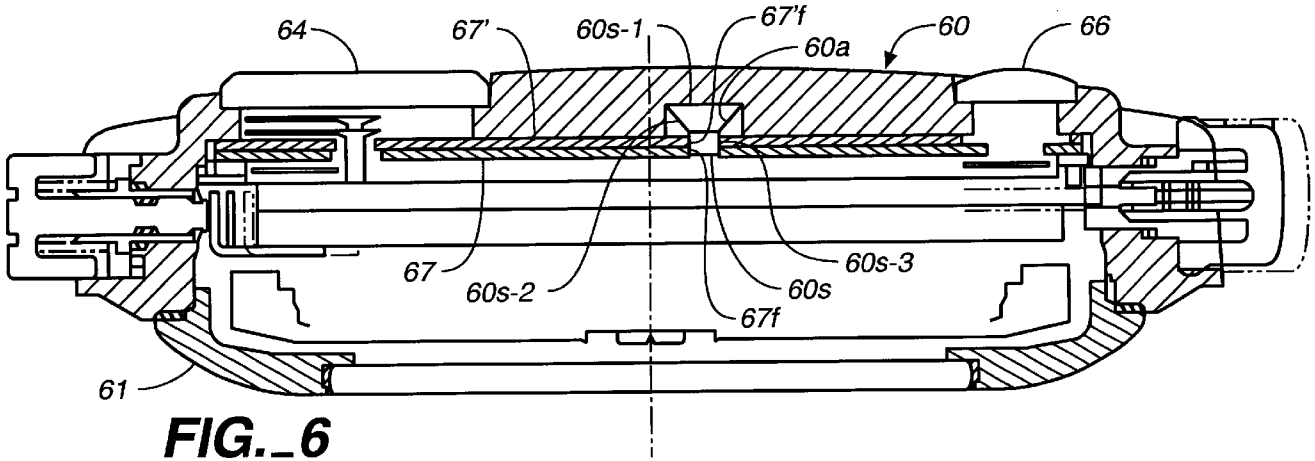
FIG. 6 is a schematic cross-sectional diagram illustrating a watch proper according to a third embodiment cut at a the periphery.
Figure 7:
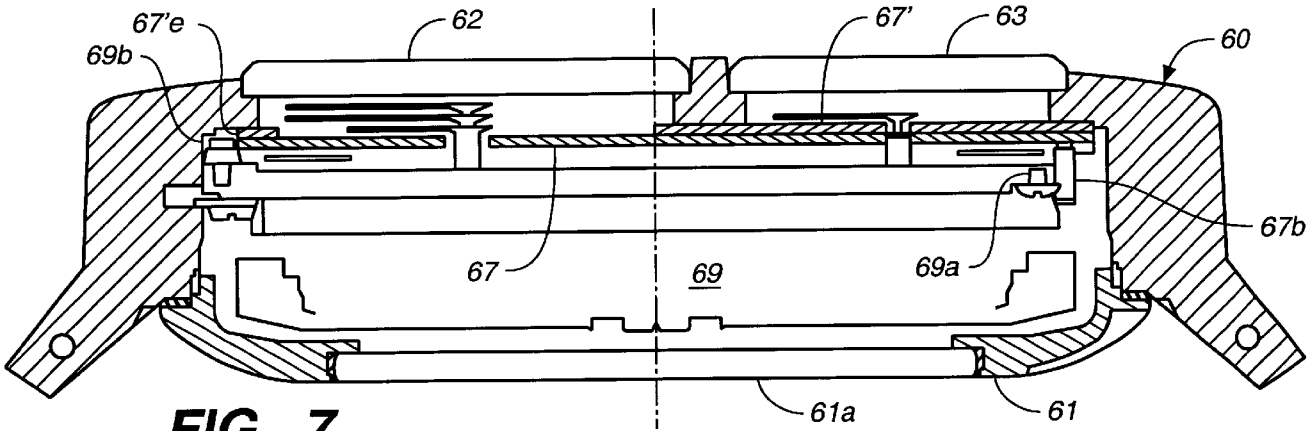
FIG. 7 is a schematic cross-sectional diagram illustrating the watch proper according to the third embodiment cut in the direction of 12 o'clock to 6 o'clock.
Figure 10:
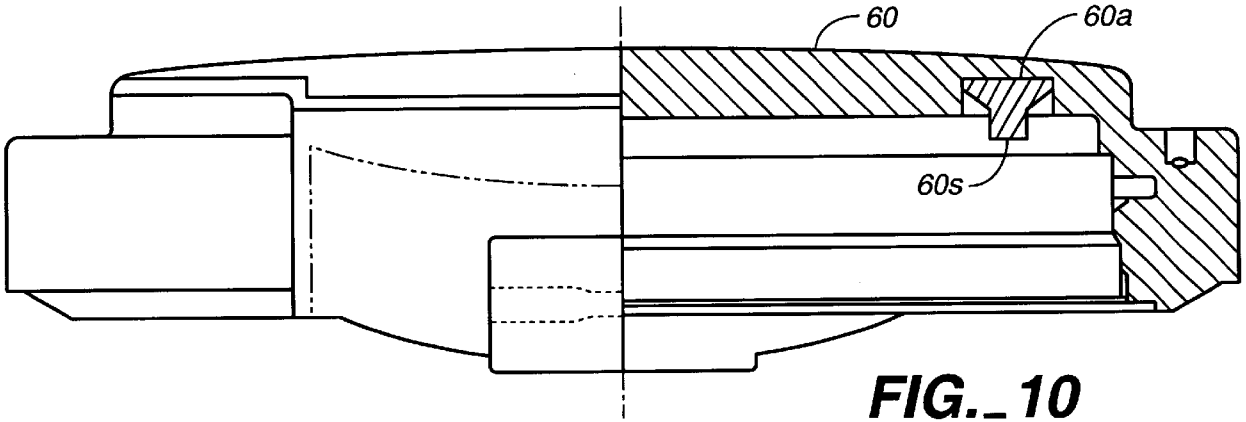
FIG. 10 is a frontal partial cross-sectional diagram illustrating the configuration of the watch case in the third embodiment.
Figure 15:
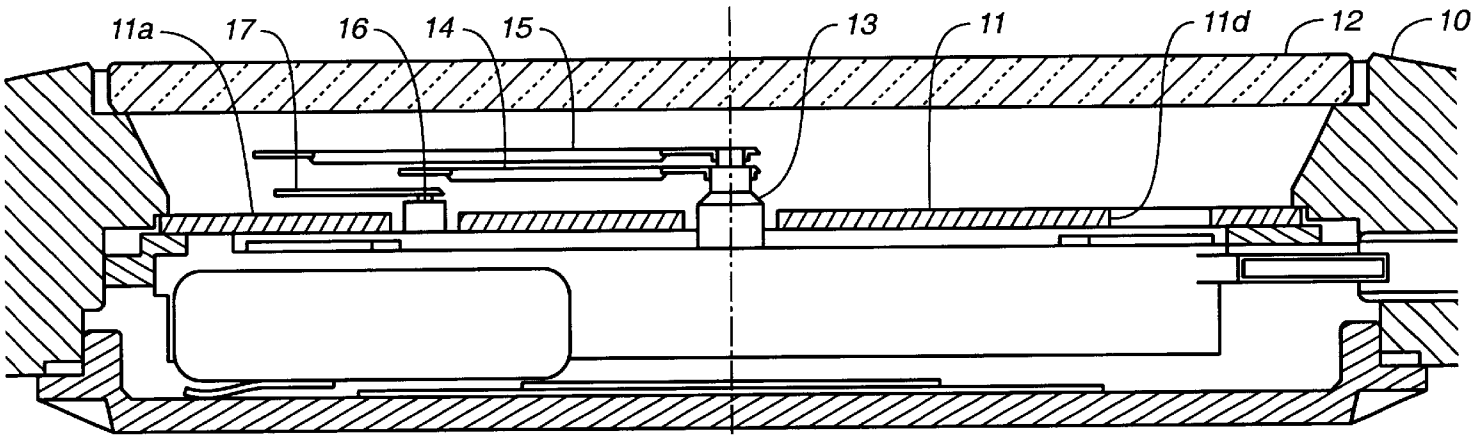
FIG. 15 is a cross-section of the structure of a watch proper according to a conventional multi-functional wristwatch cut along the 12 o'clock direction to the left, and cut along the 3 o'clock direction to the right.

Next, description will be made regarding the third embodiment of the present invention. This embodiment has an external appearance which is approximately the same as that of the above-described first embodiment, but unlike the first embodiment, has a watch case 50 equivalent to the watch case 20 and glass framing 21 in the first embodiment being integrally formed, as shown in FIG. 6 and FIG. 7, and the structure has a rear lid 61 which screws to the watch case 60 at the opposite side of the time-of-day display potion (i.e., the rear side). The form of the singular watch case 60 is shown in FIG. 10. Incidentally, a display window member 61*a* is attached to the rear lid 61, making for a rear-lid skeleton structure wherein the watch movement stored within the watch case 60 can be visually confirmed.

Figure 8:
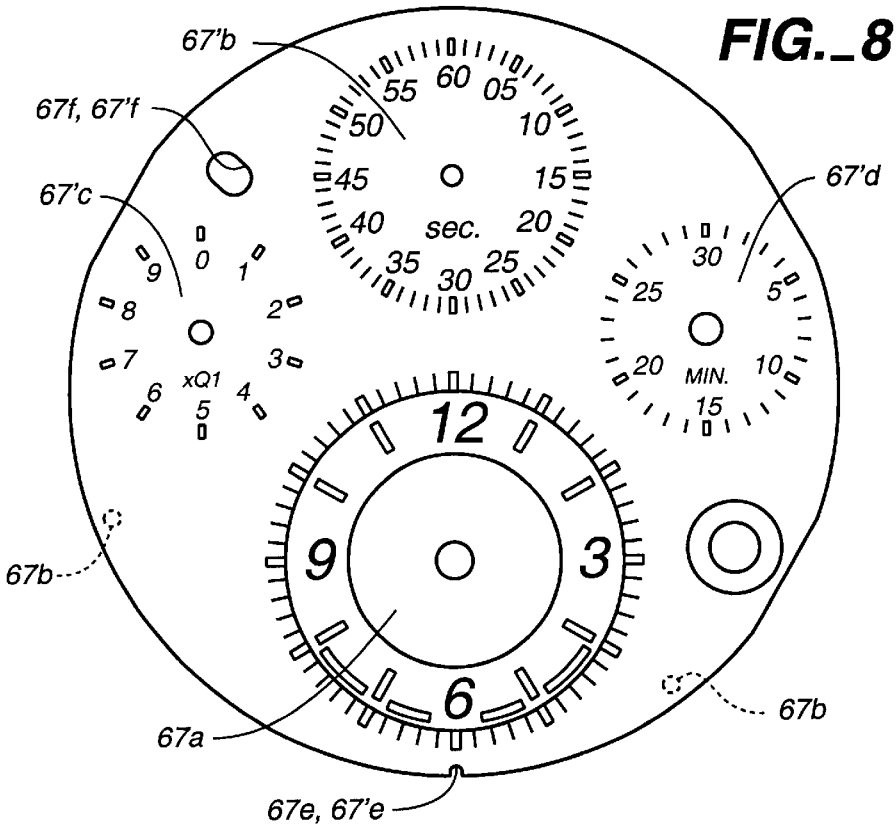
FIG. 8 is a plan view illustrating the flat form of the dial of the third embodiment.
Figure 9:
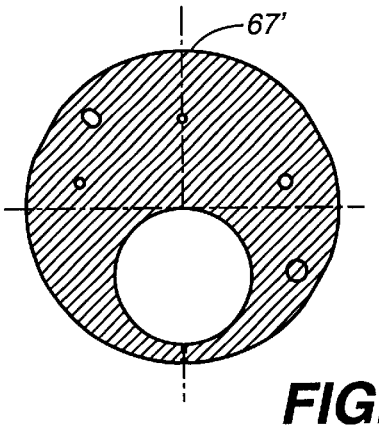
FIG. 9 is a schematic plan view illustrating the flat form of the dial to the upper side of the third embodiment.

Display window members 62, 63, 64, 65, and 66 similar to those in the first embodiment are provided to respective openings at the surface portion of the watch case 60. Also, a time-of-day indicating area 27*a* and sub-indicating areas 67′*b*, 67′*c*, and 67′*d* as shown in FIG. 8, formed of the dials 67 and 67′ layered and positioned within the watch case 60 so as to be visually recognized through the above display window members, are configured in approximately the same manner as with the first embodiment. Here, FIG. 8 is a plan view showing the sate of the dials 67 and 67′ adhered. Also, FIG. 9 shows only the flat state of the dials 67′. This flat form is approximately the same as with the first embodiment.

The dials 67 and 67′ are mutually adhered by an adhesive agent, dial legs 67*b* are attached to the dial 67 at the rear side, these dial legs 67*b* fitting to bayonets 69*a* of the watch movement 29, so that the dials 67 and 67′ are held by the watch movement 29.

Now, position-wise restriction of the dials to the watch case 60 is not performed by the dial legs 67*b*. Position-wise restriction of the dials 67 and 67′ themselves in the radial direction is performed by contact between the periphery of the dial and the inner circumference of the watch case 60. Also, position-wise restriction of the dials 67 and 67′ in the rotational direction to the watch case 60 is performed by guide holes 67*f* and 67′*f* formed in the surface of the dials 67 and 67′ fitting with positioning pons 60*s* fixed to recessions 60*a* formed in the inner plane of the watch case 60 facing the dials. Also, general position-wise restriction is performed between the dials and the watch movement 29 by means of notches 67*e* and 67′*e* formed on the periphery of the dial fitting with protrusions 69*b* provided on the periphery of the watch movement 29.

The recession 60*a* is a round hole with a circular shape when viewed flat, for example, and the positioning pin 60*s* is comprised of a base portion 60*s*-1 with a cross-sectional form which exactly engages the flat form of the recession 60*a,* an intermediate portion 60*s*-2 which is of a conical form gradually tapering from the base portion 60*s*-1, and a tip portion 60*s*-3 which extends from the intermediate portion 60*s*-2 and engages the guide holes 67*f* and 67′*f*. The positioning pin 60*s* is fixed by engaging the base portion 60*s*-1 to the recession 60*a* and then injecting an adhesive agent into the space (adhesive agent pool) formed between the intermediate portion 60*s*-2 and the inner side of the recession 60*a*. Accordingly, the positioning pin 90*s* can be fixed at a precise position on the watch case 60, and ease of the fixing task is facilitated.

The guide openings 67*f* and 67′*f* have an elongated circular form extending in the radial direction of the dials 67 and 67′, and preferably is formed at a portion of the dials close to the periphery. Position-wise restriction of the dial in the radial direction is performed by contact between the periphery of the dial and the inner circumference of the watch case 60, so the position-wise restriction of the positioning pin 60*s* and guide opening performs position-wise restriction in the rotational direction by the above elongated circular form, without interfering with position-wise restriction in the radial direction by the watch case.

Conventionally, with normal wristwatches, the watch case and watch movement are mutually positioned by a winding stem pipe connected to the case, a casing ring positioned within the case, etc., and then watch movement and dial are positioned by dial legs or the like, thus finally performing positioning between the watch case and the dial.

However, in the event that positioning between the watch case and the dial is carried out with such a method, there are many parts between the two involved in the positioning, so it is difficult to improve the precision of positioning, and particularly, in the event that small display window members are formed in the watch case as with the first embodiment or the present embodiment, shifting in position between the watch case and the dial stands out, and is a great problem.

Accordingly, with the first embodiment and the present embodiment, a positioning pin provided to the watch case is directly fit with the dial from the front side, thereby performing restriction in position. The position-wise restriction at this time may be either in the radial direction or in the rotational direction, or in both directions. Thus, position-wise restriction between the watch case and the dial can be directly performed without including may parts therebetween, thereby preventing deterioration of the outward appearance and impression of quality owing to shifting in position between the openings in the glass framing or watch case and the indicating areas of the dials visually recognized through these openings.

The positioning pin 60*s* according to the present embodiment is formed such that the base 60*s*-1 which comes into contact with the recession 60*a* is formed larger than the tip portion 60*s*-3 which fits with the dial, so the area of adhesion with the watch case 60 increases, thereby improving the attachment precision due to high precision in the degree of perpendicularly of the positioning pin 60*s* and the like, and also, the task of working the recession 60*a* of the watch case 60 becomes easy, and work precision can be improved, as well.

Also, even in cases therein the thickness wherein the positioning pin 60*s* can be disposed is small for the purpose of reducing the thickness of the wristwatch, and the positioning pin 60*s* has to be shortened in length, the precision of position-wise restriction can be improved as described above, and there is the advantage that attachment rigidity is raised, as well.

Further, according to the present embodiment, providing the fitting structure of the positioning pin 60*s* and the guide openings 67*f* and 67′*f* near the display window members 62, 63, 64, 65, and 66 allows reduction in the amount of shifting in position at the indicating areas visually recognized from the display window members. Particularly, the amount of shifting in position can be made even more unnoticeable by providing the above fitting structure near the small display window members 64, 65, and 66.

Particularly, the above fitting structure is preferably provided at a position near the periphery of dial, since the positioning precision in the rotational direction can be raised.

With the present embodiment, the watch movement 69, dials 67 and 67′, and the needles are assemble and stored integrally within the watch case, following which the rear lid 61 is attached and sealed, so rotation of the watch movement at the time of storing the same in the watch case 60 at the time of assembly can be prevented by the above fitting structure, and there is the advantage that damage to the needles and like can be prevented.

In the present embodiment, position-wise restriction between the dials 67 and 67′ and the watch case 60 is performed by contact between the periphery of dial and the inner circumference of watch case 60, and fitting of the guide holes 67*f* and 67′*f* with the positioning pin 60*s* fixed in the watch case 60, so in either case, positioning is performed by direct position-wise restriction between dial and watch case. Now, position-wise restriction between dial and watch case may be performed by fitting of the guide holes in the dial with the positioning pin fixed in the watch case. In this case, there is at least the need for multiple fitting portion positions to be provided on the surface of the dial.

Figure 11:
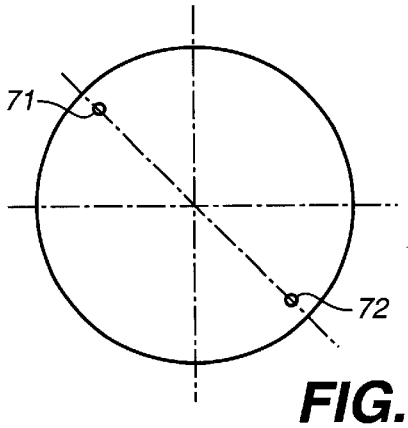
FIG. 11, FIG. 12, and FIG. 13 are explanatory diagram illustrating other examples of the fitting structure of the dial in the third embodiment.
Figure 12:
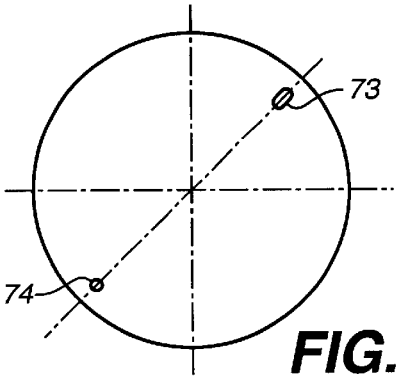
Figure 13:
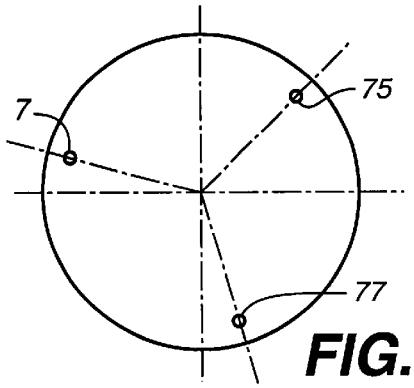

FIG. 11 through FIG. 13 show examples of arraying the fitting portions on a plane in the event that the dial and watch case are fit at multiple portions. In the example shown in FIG. 11, a pair of guide openings 71 and 72 are formed at positions rotated by 180 degrees on the dial (positioned symmetrically) and corresponding to these are a pair of unshown fitting pins provided to the watch case. In this case, the dial is positioned in both the radial direction and rotational direction to the watch case by the pair of guide openings 71 and 72. In this case, it is preferable that the pair of guide openings 71 and 72 are provided symmetrically. Now, the array of the guide openings does not need to be precisely symmetrical, but the further removed from one another they are, the higher the precision of positioning the dial is.

In the example shown in FIG. 12, a pair of guide openings 73 and 74 are formed at positions symmetrical as with the example shown in FIG. 11, but differs from this example in that the guide opening 74 is an elongated hole extended in the radial direction. In this example, the position-wise restriction of the dial is performed in the radial direction by the guide opening 74, and position-wise restriction of the dial is performed in the rotational direction by the relative positions of the guide openings 73 and 74. Accordingly, in order to position the dial precisely, it is preferable that the guide opening 74 be positioned in the direction in which the elongated hole of guide opening 73 extends.

In the examples shown in FIG. 13, three guide openings 75, 76 and 77 are formed at positions mutually scattered in different directions. The dial is positioned in both the radial direction and rotational direction to the watch case by the three guide openings. It is preferable that the guide openings are formed at positions mutually scattered, e.g., it is preferable that each is positioned at a different position at increments of 120 degrees as viewed from center of the dial.

Conversely, in the above structure, positioning may be performed by fitting between pins fixed to the dial and guide holes formed in the watch case.

Industrial Applicability

As described above, according to the present invention, the time indicating area in the display system and the sub-indicating area in the sub-display system are positioned so as to not overlap on a plane, so deterioration in visual recognition owing to a needle of one covering the display of another, or erroneous reading of the displays can be prevented. Also, owing to the same reason, the design of the display portion is not complicated, there are fewer restrictions on design from overlapping of the time indicating area and the sub-indicating area, facilitating relatively free configuration of a simple design.

Also, a time displaying window for allowing visual recognition of the time indicating area and sub-displaying windows for allowing visual recognition of the sub-indicating areas are separately provided, thereby improving visual recognition, and improving designability.

What is claimed is:

1. A time piece, comprising on the face of a dial:

a plurality of display systems for displaying time-of-day, time, or other physical quantities; and a covering having a plurality of time displaying windows for allowing individual visual recognition of each of said display systems wherein said covering has a fitting structure which fits to said dial and performs position restriction, said fitting structure including a fitting pin fit into a receiving recession formed in said covering and fixed thereto, with a guide hole or guide opening to which said fitting pin may fit being formed in said dial, said fitting pin including a base portion, a tip portion, and an intermediate portion, said base portion having a bottom plane form which approximately matches the bottom portion of said receiving recession, said tip portion protruding from said receiving recession and being configured so as to fit with said dial, said intermediate portion having a tapered form so as to secure space for an adhesive to pool.

2. A time piece according to claim 1, wherein said fitting structure is provided to a rear side of said covering at portions other than said time displaying windows.

3. A time piece according to claim 1 or claim 2, wherein said dial is restricted position-wise in the radial direction by another member besides said fitting structure, and is restricted position-wise in the rotational direction by said fitting structure.

4. A time piece according to claim 3, wherein said dial and said fitting structure are fit with leeway in the radial direction.

5. A time piece according to claim 1 or claim 2, wherein a plurality of said fitting structures fit with said dial, so that said dial is restricted position-wise in the radial direction and in the rotational direction.

6. A time piece according to claim 5, having fitting leeway in the radial direction to said dial, and comprising a first said fitting structure which performs positional restricting in the rotational direction, and a second said fitting structure which performs positional restricting in the radial direction.

7. A time piece comprising on the face of a dial provided on a display portion for making various types of display:

a plurality of display systems for displaying time-of-day, time, or other physical quantities; and a covering having a plurality of time displaying windows for allowing individual visual recognition of each of said display systems, wherein said covering has a fitting structure which fits to said dial and performs position restriction.

* * * * *